US012129079B2

(12) United States Patent
Gordon

(10) Patent No.: US 12,129,079 B2
(45) Date of Patent: Oct. 29, 2024

(54) RESEALABLE AIRTIGHT STORAGE JAR ASSEMBLY

(71) Applicant: Rodawg Holdings LLC, Miami, FL (US)

(72) Inventor: Zachary B. Gordon, Miami, FL (US)

(73) Assignee: Rodawg Holdings LLC, Miami, FL (US)

( * ) Notice: Subject to any disclaimer, the term of this patent is extended or adjusted under 35 U.S.C. 154(b) by 0 days.

(21) Appl. No.: 17/717,602

(22) Filed: Apr. 11, 2022

(65) Prior Publication Data

US 2023/0192361 A1 Jun. 22, 2023

Related U.S. Application Data

(60) Provisional application No. 63/291,834, filed on Dec. 20, 2021.

(51) Int. Cl.
*B65D 41/04* (2006.01)
*B65D 1/10* (2006.01)
(Continued)

(52) U.S. Cl.
CPC ..... *B65D 41/0442* (2013.01); *B65D 1/10* (2013.01); *B65D 2251/205* (2013.01)

(58) Field of Classification Search
CPC ..... B65D 1/10; B65D 2251/205; B65D 41/0442; B65D 50/041; B65D 2543/00564; B65D 41/0435; B65D 41/0457; B65D 41/08; B65D 41/083; B65D 41/34; B65D 50/04; B65D 51/16; B65D 51/18; B65D 55/02; A61J 1/00; A61J 1/03; A61J 1/1412; A61J 1/1418; A61J 1/1425; A61J 1/1437; A61J 1/1468; A61J 1/1481; A61J 1/2037;
(Continued)

(56) References Cited

U.S. PATENT DOCUMENTS 3,260,393 A * 7/1966 Roberts ..... B65D 50/041 215/220
3,343,697 A * 9/1967 Roberts ..... B65D 50/041 215/220
(Continued)

FOREIGN PATENT DOCUMENTS

DE 3838450 A1 * 5/1990 ..... B60K 15/05

*Primary Examiner* — Anthony D Stashick
*Assistant Examiner* — Marcos Javier Rodriguez Molina
(74) *Attorney, Agent, or Firm* — Johnson | Dalal; Mark C. Johnson

(57) ABSTRACT

A resealable airtight storage jar assembly that includes a portable jar body defining ajar opening, an inner cap member with an internal sidewall extending from an upper wall and an inner cap sidewall extending from the upper wall and defining a threaded configuration corresponding to a threaded configuration defined on a sidewall of the portable jar body, wherein the inner cap member is operably configured to have a hermetically sealed position covering the jar opening. The jar assembly also includes an outer cap member with a lip radially extending from a sidewall thereon and to restrict longitudinal movement of the inner cap member thereover. The jar assembly also includes an elastomeric gasket coupled to the inner cap member and operably configured to seat over and seal the jar body defining the jar opening.

9 Claims, 6 Drawing Sheets

(51) Int. Cl.
*B65D 43/02* (2006.01)
*B65D 50/04* (2006.01)
*B65D 53/02* (2006.01)

(58) Field of Classification Search
CPC ..... A61J 1/2051; A61J 1/2055; A61J 1/2096; A61J 7/0046; A61J 7/0053; A61J 7/0076; A61J 7/02; A61J 7/04; A61J 7/0409
USPC ..... 215/270, 220
See application file for complete search history.

(56) References Cited

U.S. PATENT DOCUMENTS 3,432,069 A 3/1969 Craig
4,190,173 A 2/1980 Mason et al.
4,520,938 A * 6/1985 Finke ..... B65D 50/041 215/220
8,006,851 B2 * 8/2011 Morini ..... B65D 51/002 215/277
8,403,166 B2 3/2013 Steininger
9,211,040 B2 12/2015 Lane
9,681,771 B2 6/2017 Herling et al.
10,104,995 B2 10/2018 Kelaher et al.
10,292,478 B2 5/2019 Montoli
10,414,555 B2 9/2019 Steinmann et al.
11,059,637 B2 * 7/2021 Roto ..... B65D 50/041
2002/0036207 A1 3/2002 Ohuo et al.
2005/0224445 A1 * 10/2005 Gancia ..... B65D 41/0442 215/217
2009/0250425 A1 * 10/2009 Yoshihiro ..... B65D 50/041 215/316
2010/0133285 A1 6/2010 Schepen et al.
2019/0337688 A1 * 11/2019 Roto ..... B65D 50/041

* cited by examiner

RESEALABLE AIRTIGHT STORAGE JAR ASSEMBLY

FIELD OF THE INVENTION

The present invention relates generally to portable storage containers and, more particularly, relates to a resealable and airtight glass storage jar.

BACKGROUND OF THE INVENTION

Various fungible commodities, including herbs and smoking substances, require proper storage to preserve and protect the integrity, quality, texture, consistency, flavor, and other related properties of the stored commodity. Often, this entails providing a resealable and airtight glass jar that can readily and repeatedly be resealed in an airtight configuration. Many known devices provide said airtight seal through a heat induction liner, but said devices are severely limited by the fact that heat induction liners are only effective as once-off airtight seals. In other words, once the liner is peeled off by a consumer, the storage jar or container no longer maintains airtightness. To become airtight again, another heat induction liner must be affixed to the storage jar using a heat induction sealing machine. Given that a heat induction sealing machine may not be widely available and are often costly to purchase, this type of resealing technology is not practical, convenient, or cost-effective. In turn, this shortcoming has generated a need for airtight technology that can quickly and readily be activated without using external tools, methods, or equipment.

Other known sealing devices are not configured in a way to effectuate or ensure an airtight seal around the upper rim of the container desired to be sealed. Specifically, many of those known sealing devices utilize an elastic seal that sits on the inside surface or outside surface of the container that routinely fails under repeated use and/or otherwise do not provide an effective seal or hermetic seal. Additionally, those known sealing devices have a seal that often become dislodged after repeated use.

Therefore, a need exists to overcome the problems with the prior art as discussed above.

SUMMARY OF THE INVENTION

The invention provides a resealable airtight storage jar assembly that overcomes the hereinafore-mentioned disadvantages of the heretofore-known devices and methods of this general type and that effectively, efficiently and safely seals the contents therein.

With the foregoing and other objects in view, there is provided, in accordance with the invention, a releasable airtight storage jar assembly having a portable jar body with a first end defining a jar opening, a second end opposite the first end, a sidewall defining a threaded configuration thereon, and a bottom wall defining, with the sidewall, a storage cavity spatially coupled to the jar opening. The jar assembly also includes an inner cap member with an upper wall, an internal sidewall extending from the upper wall of the inner cap member, and an inner cap sidewall extending from the upper wall of the inner cap member and defining a threaded configuration corresponding to the threaded configuration defined on the sidewall of the portable jar body, wherein the inner cap member is operably configured to have a sealed position along a cap-jar coupling path with the inner cap member covering the jar opening and hermetically sealing the storage cavity. The jar assembly also includes an outer cap member with an upper wall and an outer cap sidewall extending from the upper wall and including a lip radially extending from an inner surface of the outer cap member and configured to restrict longitudinal movement of the inner cap member thereover, wherein the inner cap member is interposed between the lip and the upper wall of the outer cap member. Additionally, the assembly includes an elastomeric gasket with an upper surface disposed proximal to the upper wall of the inner cap member, with a lower surface opposing the upper surface of the elastomeric gasket, with an inner wall defining a central aperture with the internal sidewall disposed therein and with the inner wall disposed proximal to the internal sidewall, with an outer wall disposed proximal to the inner cap sidewall, and, when in the sealed position, with the lower surface of the elastomeric gasket seated directly over and contacting the first end of the portable jar body that defines the jar opening.

In accordance with a further feature of the present invention, the lip spans continuously around a perimeter of the inner surface of the outer cap member.

In accordance with another feature of the present invention, the upper surface and the lower surface of the elastomeric gasket are substantially planar.

In accordance with yet another feature of the present invention, the upper surface and the lower surface of the elastomeric gasket are both substantially planar.

In accordance with a further feature of the present invention, the inner wall of the elastomeric gasket is compressively retained to the inner cap sidewall.

In accordance with another feature, an embodiment of the present invention includes the sidewall of the portable jar body having an upper edge that defines the jar opening and, when in the sealed position, has the lower surface of the elastomeric gasket seated directly thereon and contacting.

In accordance with an additional feature of the present invention, the internal sidewall and the inner wall are both of an annular shape and with inner wall having a diameter less than a diameter of the internal sidewall.

In accordance with a further feature of the present invention, the storage cavity is less than 800 $cm^3$, thereby providing a handheld portable jar body.

In accordance with an exemplary feature of the present invention, the outer cap member and inner cap member are of a substantially rigid polymeric material.

In accordance with a further feature of the present invention, the portable jar body is of a transparent glass.

In accordance with another feature, an embodiment of the present invention also includes the inner cap member operably configured to independently translate longitudinally and rotate relative to the outer cap member and includes a lower surface of the upper wall of the outer cap member and an upper surface of the upper wall of the inner cap member, wherein the lower surface of the upper wall of the outer cap member and the upper surface of the upper wall of the inner cap member having, collectively, a plurality of raised surfaces operably configured to engage with one another to selectively and simultaneously rotate the inner cap member and the outer cap member.

Although the invention is illustrated and described herein as embodied in a resealable airtight storage jar assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the resealable airtight storage jar, or spanning from the bottom surface or wall from the upper surface or lower surface of a cap.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF THE INVENTION

The present invention provides a novel, resealable, and portable airtight storage jar that overcomes the heretofore-mentioned disadvantages of the heretofore-known devices and methods of this general type and that is operably configured to be selectively and easily resealed with an airtight seal for greater convenience and ease of use. The storage jar may be repeatedly opened and closed, with an airtight seal being formed each time the storage jar is closed such that the commodities stored within the storage jar substantially preserve their quality, texture, consistency, flavor, and other related properties. The present invention also comprises a child-resistant inner cap that substantially prevents tampering by infants or children.

Figure 1:
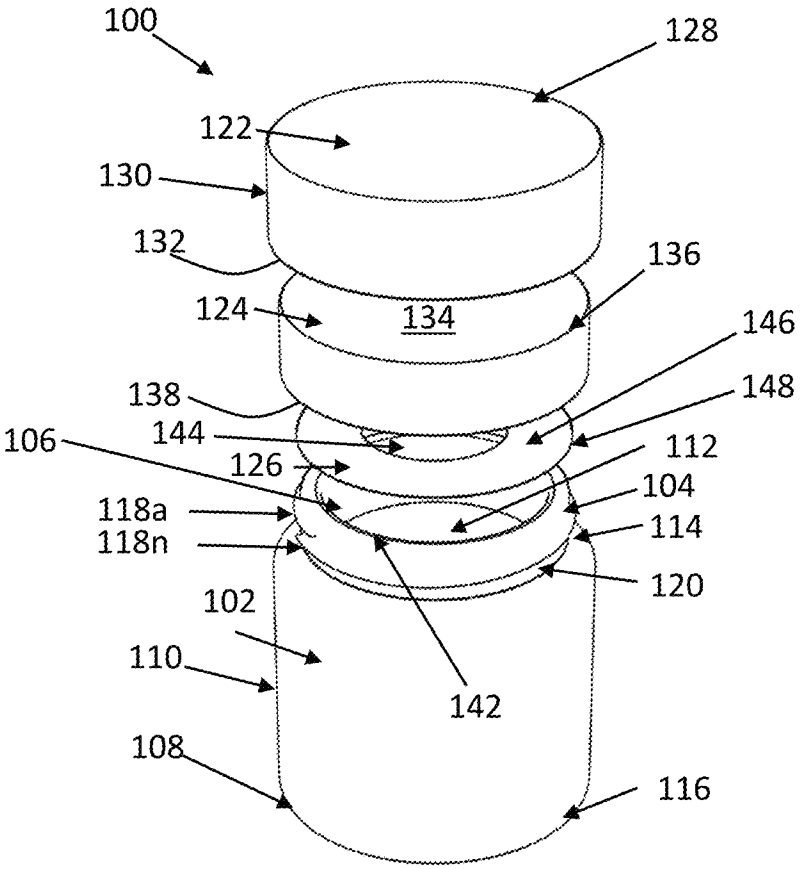
FIG. 1 is an exploded view of a resealable airtight storage jar assembly, in accordance with an exemplary embodiment of the present invention.
Figure 2:
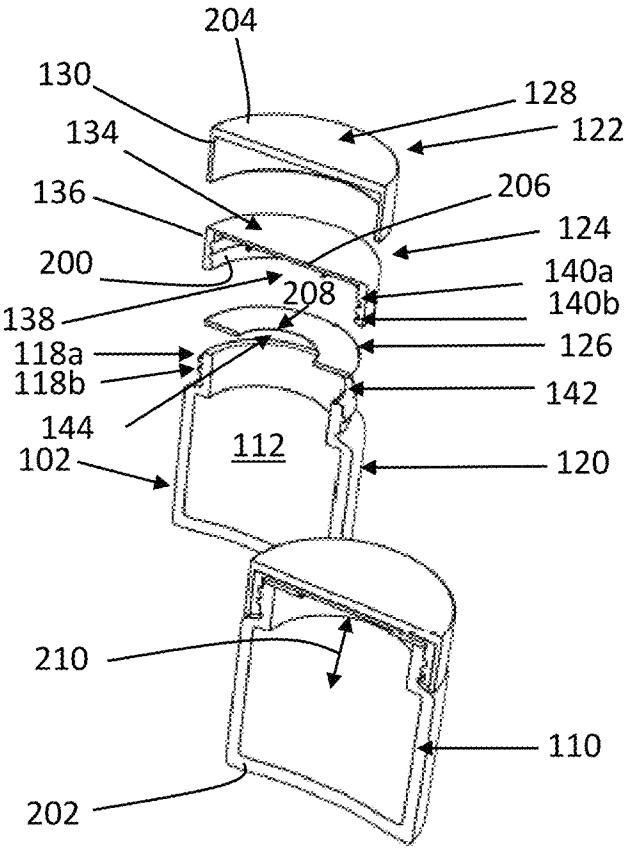
FIG. 2 is an exploded and cross-sectional view of the resealable airtight storage jar assembly, in accordance with the present invention.

Referring now to FIGS. 1-2, one embodiment of the present invention is shown in exploded views. FIGS. 1-2 (along with the other figures depicted herein) show several advantageous features of the present invention, but, as will be described below, the invention can be provided in several shapes, sizes, combinations of features and components, and varying numbers and functions of the components.

The present invention provides a resealable airtight storage jar 100 (hereinafter referred to as "device 100" for brevity). Embodiments of the invention provide a device 100 comprising ajar body 102 with a first end 104 defining a jar opening 106, a second end 108 opposite the first end 104, and a sidewall 110 separating the first end 104 and the second end 108, defining a storage cavity 112, and having an upper end 114 and lower end 116, the upper end 114 of the sidewall 110 having a plurality of grooves 118*a-n* (wherein "n" refers to any number greater than one) disposed on an outer surface 120 of the sidewall 110. In an exemplary embodiment, the jar body 102 is of a glass composition weighing approximately 30 drams for reduced breakage and greater visibility into the contents of the storage cavity 112. The jar body 102 is between 50 and 120 millimeters in width and between 50 and 60 millimeters in length. Exemplary capacity of the storage cavity 112 is approximately between 2 and 5 ounces, ideal for herbs and smoking substances. The upper end 114 of the sidewall 110 has a threaded configuration (as exemplified in FIG. 1) that may include one or more grooves and one or more ridges, but may preferably include a plurality of grooves 118*a-n,* defined by ridges, disposed on the outer surface 120 of the sidewall 110 to facilitate a secure closure between the jar body 102 and the cap structure of the device 100.

The cap structure of the jar assembly 100 is comprised of several parts including an outer cap member 122 (or "outer cap"), an inner cap member 124 (or "inner cap"), and a retained polymeric gasket 126. The outer cap 122 has a substantially planar upper surface 128, enabling multiple units to be stacked on top of one another for space-efficient storage and organization, and an outer cap sidewall 130 defining an outer cap opening 132. The outer cap member 122 may be comprised of a variety of materials and finishes including, without limitation, wood (e.g., ebony, oak, bamboo, etc.), matte plastic, and gloss plastic. The outer cap 122 also prevents foreign, external objects or particles from entering the storage cavity 112 and compromising the integrity, quality, texture, consistency, flavor, and other related properties of the stored commodity.

The inner cap member 124 is of a plastic material composition and has a substantially planar upper surface 134 directly coupled to the outer cap 122 and an inner cap sidewall 136 defining an inner cap opening 138, the inner cap sidewall 136 having a threaded configuration (as exemplified in FIG. 2) that may include one or more grooves and one or more ridges, but may preferably include a plurality of grooves 140*a-n* (wherein "n" refers to any number greater than one), defined by ridges, disposed on an inner surface 200 of the inner cap sidewall 136. The substantially planar upper surface 134 of the inner cap 124 may be directly coupled to the substantially planar upper surface 128 of the outer cap 122 using an adhesive or may be mechanically coupled to form a single monolithic structure. The plurality of grooves 140*a-n* disposed on the inner cap sidewall 136 are proportionately sized and shaped to form a seal and/or coupling configuration with the plurality of grooves 118*a-n* disposed on the outer surface 120 of the sidewall 110. Said differently, the cap structure is selectively removably coupled to the jar body 102 in a threaded and sealed configuration.

Figure 3:
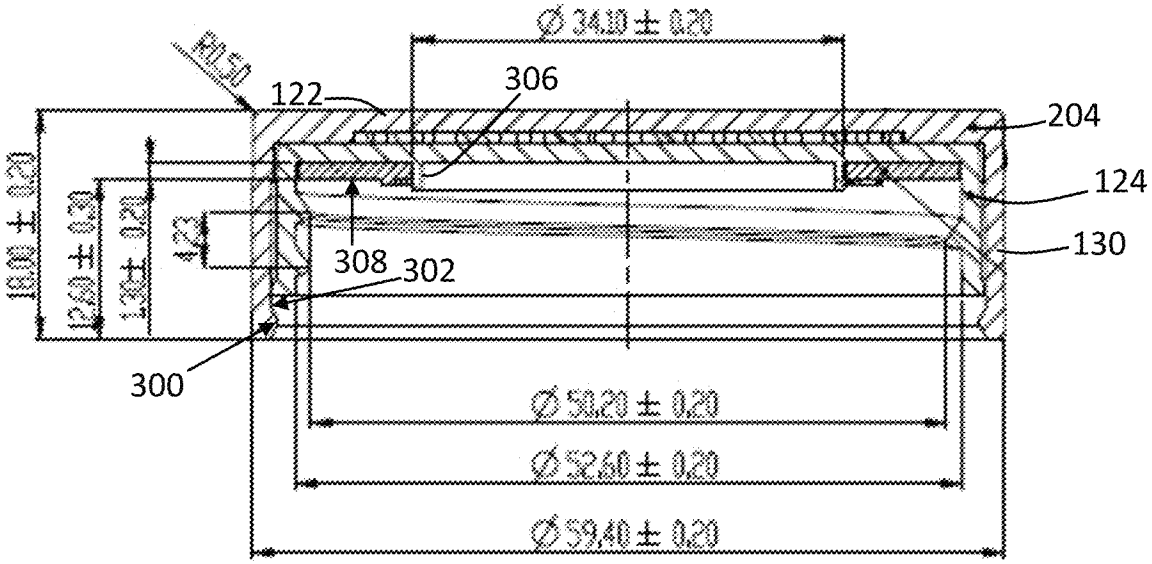
FIG. 3 is a cross-sectional view of a cap assembly, depicting exemplary dimensions therewith, utilized with the resealable airtight storage jar assembly in accordance with one embodiment of the present invention.
Figure 5:
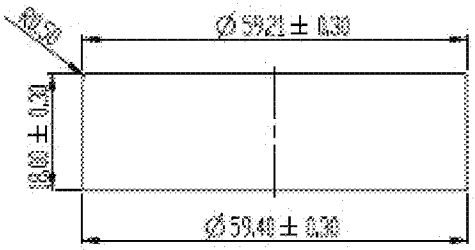
FIGS. 4-6 are views of an outer cap member, depicting exemplary dimensions therewith, utilized with the cap assembly in FIG. 3 in accordance with one embodiment of the present invention.
Figure 4:
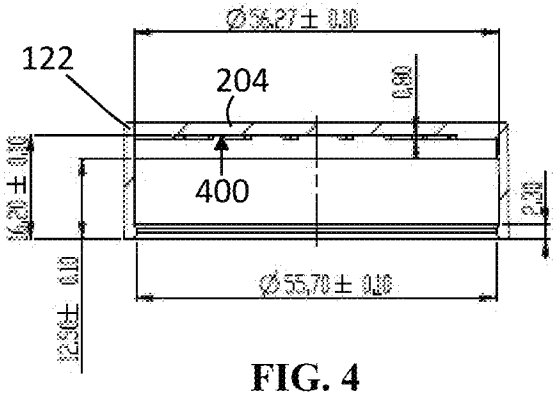
Figure 6:
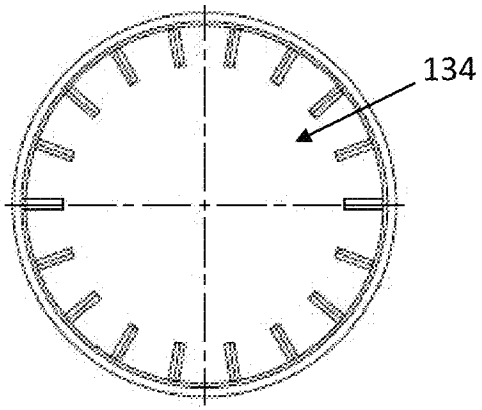
Figure 7:
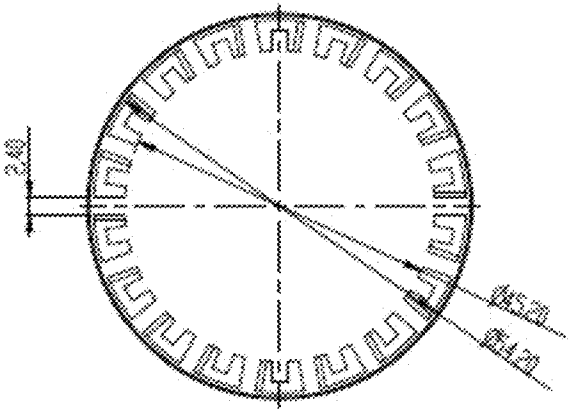
FIGS. 7-9 are views of an inner cap member, depicting exemplary dimensions therewith, utilized with the cap assembly in FIG. 3 in accordance with one embodiment of the present invention.
Figure 8:
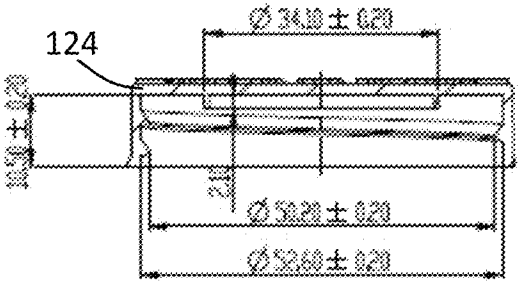
Figure 9:
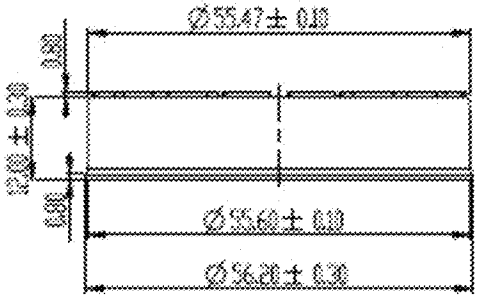

Aside from serving as a second layer of protection against foreign, external objects or particles, the inner cap 124 also functions as a child resistant mechanism which substantially prevents tampering by infants or children and, more importantly, access to the stored commodities housed within the storage cavity 112 by infants and children. Beneficially, this feature serves as a safeguard for the safety and well-being of children who should not ingest the contents of the storage cavity 112, e.g., herbs, smoking substances, etc. To that end, the outer cap member 122 includes an upper wall 204 and an outer cap sidewall 130 extending from the upper wall 204, preferably at a 90° angle. With reference to FIG. 1 and FIG. 3, the outer cap sidewall 130 beneficially includes a lip 300 radially extending (approximately 1-5 mm) from an inner surface 302 of the outer cap member 122 and is configured to restrict longitudinal movement of the inner cap member 124 thereover, i.e., the lip 300 extends a sufficient length outwardly to prevent the inner cap member 124 from moving passed the lip 300. The inner cap member 124 is interposed between the lip 300 and the upper wall 204 of the outer cap member 122 and may, in some embodiments, the inner cap member 124 be adhesively coupled to the inner surface 302 of the outer cap member 122. Additionally, the lip 300 may span continuously around a perimeter of the inner surface 302 of the outer cap member 122, namely on the outer cap sidewall 130 thereon, to further inhibit and/or resist movement of the inner cap member 124 that could cause failure of the assembly 100.

The retained polymeric gasket 126 functions to form an airtight seal that protects the integrity, quality, texture, consistency, flavor, and other related properties of the stored commodity. Specifically, the pliable or flexible property of the polysiloxane, or silicone, gasket 126 substantially plugs up and seals off any air channels or bubbles existing between the inner cap sidewall 136 and the jar body sidewall 110 when the inner cap 124 is screwed onto the upper end 114 of the jar body sidewall 110, forming a threaded and hermetically sealed configuration. Unlike heat induction liners, the retained polymeric gasket 126 forms an airtight seal each time the cap structure (consisting of the outer cap 122, the inner cap 124, and the retained polymeric gasket 126) is tightly screwed onto the upper end 114 of the jar body sidewall 110 without requiring the use of any external tools, methods, or equipment including, without limitation, heat induction sealing machines. This feature significantly improves the convenience and ease of use of the device 100 because it quickly and easily facilitates an airtight seal even upon repeated uses of the device 100, i.e., an airtight seal is created each time the cap or lid structure is screwed onto the jar body 102, and eliminates the need for heat induction sealing machines. Less time, energy, and resources, therefore, is spent on creating the airtight seal as there are no additional actions a user needs to take to form the airtight seal aside from simply screwing the cap structure onto the jar body 102. Preferably, the retained polymeric gasket 126 is substantially planar or flat and circular, spanning around the circumference of the jar body opening 106. When screwed onto the jar body 102, the retained polymeric gasket 126 is interposed between an upper edge 142 of the jar body sidewall 110 and the substantially planar upper surface 134 of the inner cap 124 to form an airtight seal. Specifically, the retained polymeric gasket 126 maintains direct contact with the upper edge 142 of the jar body sidewall 110 even when the cap structure is twisted and pulled. The retained polymeric gasket 126 is directly coupled to the inner cap using an adhesive or may be mechanically coupled to form a single monolithic structure, and defines a central aperture 144 that is approximately the same size and shape as the jar body opening 106.

Said another way and with reference to FIGS. 1-3, the aforementioned resealable airtight storage jar assembly 100 includes a portable jar body 102 with a first end 104 defining a jar opening 106, a second end 108 opposite the first end 104, a sidewall 110 defining a threaded configuration thereon and, in preferred embodiments, an upper edge 142 that defines he jar opening 106, and a bottom wall 202 defining, with the sidewall 110, a storage cavity 112 spatially coupled, i.e., providing direct access, to the jar opening 106. The assembly 100 also includes an inner cap member 124 with an upper wall 206, an internal sidewall 306 extending from the upper wall 206 of the inner cap member 124, preferably at a substantially perpendicular angle (i.e., +/−15°. The jar assembly 100 also includes an inner cap sidewall 136 extending from the upper wall 206 of the inner cap member 124, preferably at a substantially perpendicular angle and that is parallel to the internal sidewall 306, and that defines a threaded configuration corresponding to the threaded configuration defined on the sidewall 110 of the portable jar body 102. The inner cap member 124 is operably configured to have a sealed position (exemplified in FIG. 2) along a cap jar coupling path, e.g., represented with arrow 210, having the inner cap member 124 covering the jar opening and hermetically sealing the storage cavity 112. The inner cap member 124, along with the outer cap member 122, has an uncoupled position (also exemplified in FIG. 2) with the cap removed from the jar body 102.

The assembly 100 also includes an outer cap member 122 with an upper wall 204 and an outer cap sidewall 130 extending from the upper wall 204 and including a lip 300 radially extending, preferably at a substantially perpendicular angle, from an inner surface 302 of the outer cap member 122 and configured to restrict longitudinal movement of the inner cap member 124 thereover. The inner cap member 124 is interposed between the lip 300 and the upper wall 204 of the outer cap member 122 and is operably configured to translate longitudinally up and down and rotate relative to the outer cap member 122.

The elastomeric gasket 126 includes an upper surface 146 disposed proximal (i.e., directly adjacent to or within approximately 7 mm from) the upper wall 206 of the inner cap member 124, with a lower surface 308 opposing the upper surface 146 of the elastomeric gasket 126, with an inner wall 208 defining a central aperture 144 with the internal sidewall 306 disposed therein and with the inner wall 208 disposed proximal to the internal sidewall 306, with an outer wall 148 disposed proximal to the inner cap sidewall 136, and, when in the sealed position, with the lower surface 308 of the elastomeric gasket 125 seated directly over and contacting the first end, or upper edge 142, of the portable jar body 102 that defines the jar opening 106. The elastomeric gasket 126 is preferably of a natural or synthetic polymer having elastic properties, e.g., rubber.

Figure 10:
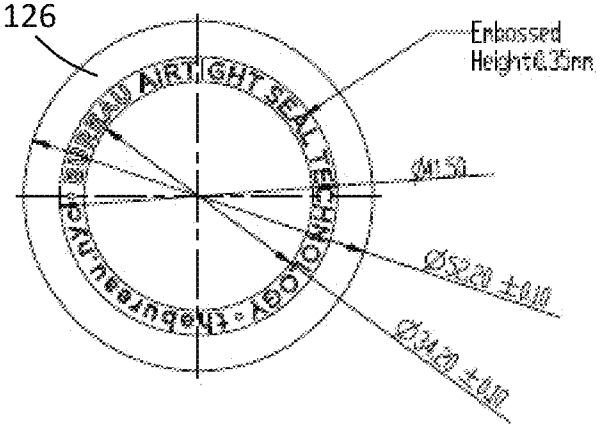
FIGS. 10-11 are views of an elastomeric gasket, depicting exemplary dimensions therewith, utilized with the cap assembly in FIG. 3 in accordance with one embodiment of the present invention.
Figure 11:
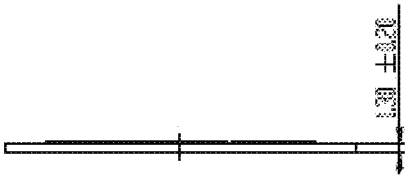

In one embodiment, the lip 300 spans continuously around a perimeter of the inner surface 302 of the outer cap member 122, while in other embodiments, it may discontinuously span around the inner surface 302, i.e., have spaces with no lip 300 protrusions, but of a sufficient length to retain the inner cap member 124 when moved longitudinally by the user. Having a continuous lip 300 enables the cap assembly, e.g., outer and inner cap members 122, 124 and gasket 126, to be repeatedly utilized with minimal risk of failure. The upper surface 146 and the lower surface 308 of the elastomeric gasket 126 are preferably substantially planar, i.e., flat without any sharp or raised protrusions spanning from edge-to-edge, to beneficially ensure a secure hermetic seal with the upper edge 142 of the body 102 and attachment to the inner cap member 124. In preferred embodiments, the inner wall 208 of the elastomeric gasket 126 is compressively retained to the inner cap sidewall 136. In other embodiments, the elastomeric gasket 126 may also be adhesively retained to the inner cap member 124. When the cap assembly is placed in the sealed position relative to the jar body 102, the lower surface 308 of the elastomeric gasket 125 is seated directly thereon and contacting the upper edge 142 around the perimeter thereon. As best seen in FIG. 10, the gasket 126 has a width separating the inner wall 208 and the outer wall 148 that is larger than the width of the upper edge 142.

The internal sidewall 306 and the inner wall 208 are also both preferably of an annular shape, and with inner wall 208 having a diameter less than a diameter of the internal sidewall 306. This configuration beneficially enables the compressive configuration between the gasket 126 and the internal sidewall 306. Further, the outer wall 148 of the elastomeric gasket 125 may also be compressed against the inner cap sidewall 136 of the inner cap member 124.

In one embodiment, the storage cavity 112 is less than 800 $cm^3$, thereby providing a handheld portable jar body 102 that users can make portable. The outer cap member 122 and inner cap member 124 are of a substantially rigid polymeric material, e.g., polypropylene, thereby beneficially providing a low-cost, yet durable, assembly capable of withstanding temperature differentials and insulating the perishable contents of within the storage cavity 112. To enable quick and effective identification of the contents within the storage cavity 112, the portable jar body 102 is of a transparent glass, e.g., a non-crystalline and amorphous solid.

In one embodiment, the inner cap member 124 can be described as being operably configured to independently translate longitudinally and rotate relative to the outer cap member 122, i.e., the inner cap member 124 is capable of moving up-and-down and rotate without destroying or plastically deforming the outer cap member 122 and without the outer cap member 122 moving up-and-down or rotating along with the inner cap member 124. This of course does not apply when one or more cap safety features are utilized, e.g., when outer cap member 122 is engaged with the inner cap member 124 to prevent or inhibit quick and easy uncoupling of the cap assembly from the jar body 102. Specifically, in one embodiment, a lower surface 400 of the upper wall 204 of the outer cap member 122 and an upper surface 134 of the upper wall 206 of the inner cap member 124 each include protrusions and/or recesses, i.e., a plurality of raised surfaces, that are configured to engage with one another and permit simultaneous rotation or movement. More specifically, the lower surface 400 of the upper wall 204 of the outer cap member 122 and the upper surface 134 of the upper wall 206 of the inner cap member 124 have, collectively, a plurality of raised surfaces (as shown best in FIG. 4, FIGS. 6-7, and FIG. 9) operably configured to engage with one another to selectively and simultaneously rotate the inner cap member 124 and the outer cap member 122.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A resealable airtight storage jar assembly comprising:

a portable jar body with a first end defining a jar opening, a second end opposite the first end, a sidewall defining a threaded configuration thereon, and a bottom wall defining, with the sidewall, a storage cavity spatially coupled to the jar opening;

an inner cap member with an upper wall, an internal sidewall of an annular shape, having a diameter, and extending from the upper wall of the inner cap member, and an inner cap sidewall extending from the upper wall of the inner cap member and defining a threaded configuration corresponding to the threaded configuration defined on the sidewall of the portable jar body, the inner cap member operably configured to have a sealed position along a cap-jar coupling path with the inner cap member covering the jar opening and hermetically sealing the storage cavity;

an outer cap member with an upper wall and an outer cap sidewall extending from the upper wall and including a lip radially extending from an inner surface of the outer cap member and configured to restrict longitudinal movement of the inner cap member thereover, the inner cap member interposed between the lip and the upper wall of the outer cap member; and an elastomeric gasket with a substantially planar upper surface without any sharp or raised protrusions spanning from an inner diameter to an outer diameter of the elastomeric gasket, with a substantially planar lower surface opposing the upper surface of the elastomer gasket and without any sharp or raised protrusions spanning from the inner diameter of the elastomeric gasket to the outer diameter of the elastomeric gasket, with an inner wall of an annular shape, defining a central aperture with the internal sidewall disposed therein, with a diameter less than the diameter of the internal sidewall to compressively retain the elastomeric gasket to the internal sidewall of the inner cap member, and with the inner wall disposed directly adjacent to the internal sidewall to share a common border with the internal sidewall, with an outer wall disposed proximal to the inner cap sidewall, and, when in the sealed position, with the substantially planar lower surface of the elastomeric gasket is seated directly over and contacting the first end of the portable jar body that defines the jar opening and, when the inner cap member and outer cap member are in an uncoupled position removed from the jar body, the lower surface of the elastomeric gasket remains substantially planar.

2. The resealable airtight storage jar assembly according to claim 1, wherein:

the lip spanning continuously around a perimeter of the inner surface of the outer cap member.

3. The resealable airtight storage jar assembly according to claim 1, wherein the sidewall of the portable jar body further comprises:

an upper edge that defines the jar opening and, when in the sealed position, has the lower surface of the elastomeric gasket seated directly thereon and contacting.

4. The resealable airtight storage jar assemblyaccording to claim 1, wherein:

the storage cavity is less than 800 $cm^3$, thereby providing a handheld portable jar body.

5. The resealable airtight storage jar assembly according to claim 1, wherein:

the outer cap member and inner cap member are of a substantially rigid polymeric material.

6. The resealable airtight storage jar assembly according to claim 5, wherein:

the portable jar body is of a transparent glass.

7. The resealable airtight storage jar assembly according to claim 1, the inner cap member operably configured to independently translate longitudinally and rotate relative to the outer cap member and further comprising:

a lower surface of the upper wall of the outer cap member; and an upper surface of the upper wall of the inner cap member, wherein the lower surface of the upper wall of the outer cap member and the upper surface of the upper wall of the inner cap member having, collectively, a plurality of raised surfaces operably configured to engage with one another to selectivelyand simultaneously rotate the inner cap member and the outer cap member.

8. A resealable airtight storage jar assembly comprising:

a portable jar body with a first end, a second end opposite the first end, a sidewall with an upper edge defining a jar opening and defining a threaded configuration thereon, and a bottom wall defining, with the sidewall, a storage cavity spatially coupled to the jar opening;

an inner cap member with an upper wall having an upper surface, an internal sidewall of an annular shape, having a diameter, and extending from the upper wall of the inner cap member, and an inner cap sidewall extending from the upper wall of the inner cap member and defining a threaded configuration corresponding to the threaded configuration defined on the sidewall of the portable jar body, the inner cap member operably configured to have a sealed position along a cap-jar coupling path with the inner cap member covering the jar opening and hermetically sealing the storage cavity;

an outer cap member with an upper wall having a lower surface and an outer cap sidewall extending from the upper wall and including a lip radially extending from an inner surface of the outer cap member and configured to restrict longitudinal movement of the inner cap member thereover, wherein the inner cap member is interposed between the lip and the upper wall of the outer cap member, the lower surface of the upper wall of the outer cap member and the upper surface of the upper wall of the inner cap member having, collectively, a plurality of raised surfaces operably configured to engage with one another to selectively and simultaneously rotate the inner cap member and the outer cap member, and the inner cap member operably configured to independently translate longitudinally and rotate relative to the outer cap member; and an elastomeric gasket with a substantially planar upper surface without any sharp or raised protrusions spanning from an inner diameter to an outer diameter of the elastomeric gasket, with a substantially planar lower surface opposing the upper surface of the elastomer gasket and without any sharp or raised protrusions spanning from the inner diameter of the elastomeric gasket to the outer diameter of the elastomeric gasket, with an inner wall of an annular shape, defining a central aperture with the internal sidewall disposed therein, with a diameter less than the diameter of the internal sidewall to compressively retain the elastomeric gasket to the internal sidewall of the inner cap member, and disposed directly adjacent to the internal sidewall to share a common border with the internal sidewall, and, when in the sealed position, with the substantially planar lower surface of the elastomeric gasket is seated directly over and contacting the upper edge of the sidewall of the portable jar body and, when the inner cap member and outer cap member are in an uncoupled position removed from the jar body, the lower surface of the elastomeric gasket remains substantially planar.

9. The resealable airtight storage jar assembly according to claim 8, wherein:

the lip spanning continuously around a perimeter of the inner surface of the outer cap member.

* * * * *